US005581917A

United States Patent [19]

Barden

[11] Patent Number: 5,581,917

[45] Date of Patent: Dec. 10, 1996

[54] QUICK COUPLING DEVICE

[75] Inventor: William M. Barden, Raleigh, N.C.

[73] Assignee: Caterpillar Inc., Peoria, Ill.

[21] Appl. No.: 544,628

[22] Filed: Oct. 18, 1995

[51] Int. Cl.[6] ..... E02F 3/28

[52] U.S. Cl. ..... 37/468; 172/272; 414/723

[58] Field of Search ..... 37/468, 231, 403; 172/272, 273, 275, 311, 439, 450, 456; 414/423

[56] References Cited

U.S. PATENT DOCUMENTS

| | | | |
|---|---|---|---|
| 4,116,347 | 9/1978 | Uchida | 214/145 |
| 4,242,034 | 12/1980 | Schmitz | 414/686 |
| 4,810,162 | 3/1989 | Foster | 414/723 |
| 4,881,867 | 11/1989 | Essex et al. | 414/723 |
| 5,082,389 | 1/1992 | Balemi | 403/322 |
| 5,179,794 | 1/1993 | Ballinger | 37/117.5 |
| 5,324,162 | 6/1994 | Kishi | 37/468 X |
| 5,332,353 | 7/1994 | Arnold | 37/468 X |
| 5,333,400 | 8/1994 | Sonerud | 37/468 |
| 5,400,531 | 3/1995 | Brown | 37/468 |
| 5,431,528 | 7/1995 | Jenkins et al. | 37/468 X |
| 5,456,030 | 10/1995 | Barone et al. | 37/468 |
| 5,465,513 | 11/1995 | Sonerud | 37/468 |

*Primary Examiner*—Terry Lee Melius
*Assistant Examiner*—Robert Pezzuto
*Attorney, Agent, or Firm*—Claude F. White

[57] ABSTRACT

A quick coupling device for connecting a work tool, such as a bucket, to an arm and a tilt link of a work machine includes a first hook arrangement connected to the arm and a second hook arrangement connected to the tilt link. Each hook arrangement defines a recess which engages a supporting pin connected to the work tool. An adjustable link is connected between the first and second hook arrangements and is adapted to apply a force to the hook arrangements to maintain engagement between the supporting pins and the recesses.

8 Claims, 2 Drawing Sheets

QUICK COUPLING DEVICE

TECHNICAL FIELD

This invention relates generally to a coupling device for coupling a work implement to a work machine and more particularly to a quick coupling device which provides quick and easy coupling of the work implement to the work machine.

BACKGROUND ART

Work machines, such as excavators and backhoe loaders, are generally equipped with a digging and material handling bucket. However, to enhance the value of the work machine and to add versatility, different types of work tools and different sizes of buckets are available for attaching to the boom arm assembly of the work machine. Disconnecting one work tool and attaching a different tool or bucket is often a difficult and time consuming task. Exchanging one tool for another generally requires two or more work persons, including the machine operator. Since the buckets and work tools are connected to the boom arm assembly by a plurality of pins, bolts, and other types of fasteners, a hammer and other hand tools are often required to remove one bucket and replace it with another.

The present invention is directed to overcoming one or more of the problems as set forth above.

DISCLOSURE OF THE INVENTION

In one aspect of the present invention, a quick coupling device for attaching and detaching a work implement to and from a structural arm assembly and a tilt link of a work machine includes a first hook arrangement on the structural arm and defining a first recess, a second hood arrangement on the tilt link and defining a second recess, first and second supporting pins attached to the work implement, and an adjustable link connected between the structural arm and the tilt link. The adjustable link is adapted to connect the structural arm and the tilt link to the first and second supporting pins.

Connecting and disconnecting various buckets and work implements to a work machine is often a time consuming and difficult task. A plurality of connecting pins, bolts, and other fasteners must be removed from the one bucket and re-installed on another bucket. This requires two or more work people and a variety of hand tools. The work machine, of course, is non-productive during this change over operation.

The subject quick coupling device provides a solution to the above noted problems by utilizing apparatus to quickly and easily connect, and/or disconnect, a work tool to a work machine. The subject quick coupling device makes the work machine more versatile and requires less time and effort to exchange work tools.

BEST MODE FOR CARRYING OUT THE INVENTION

Figure 1:
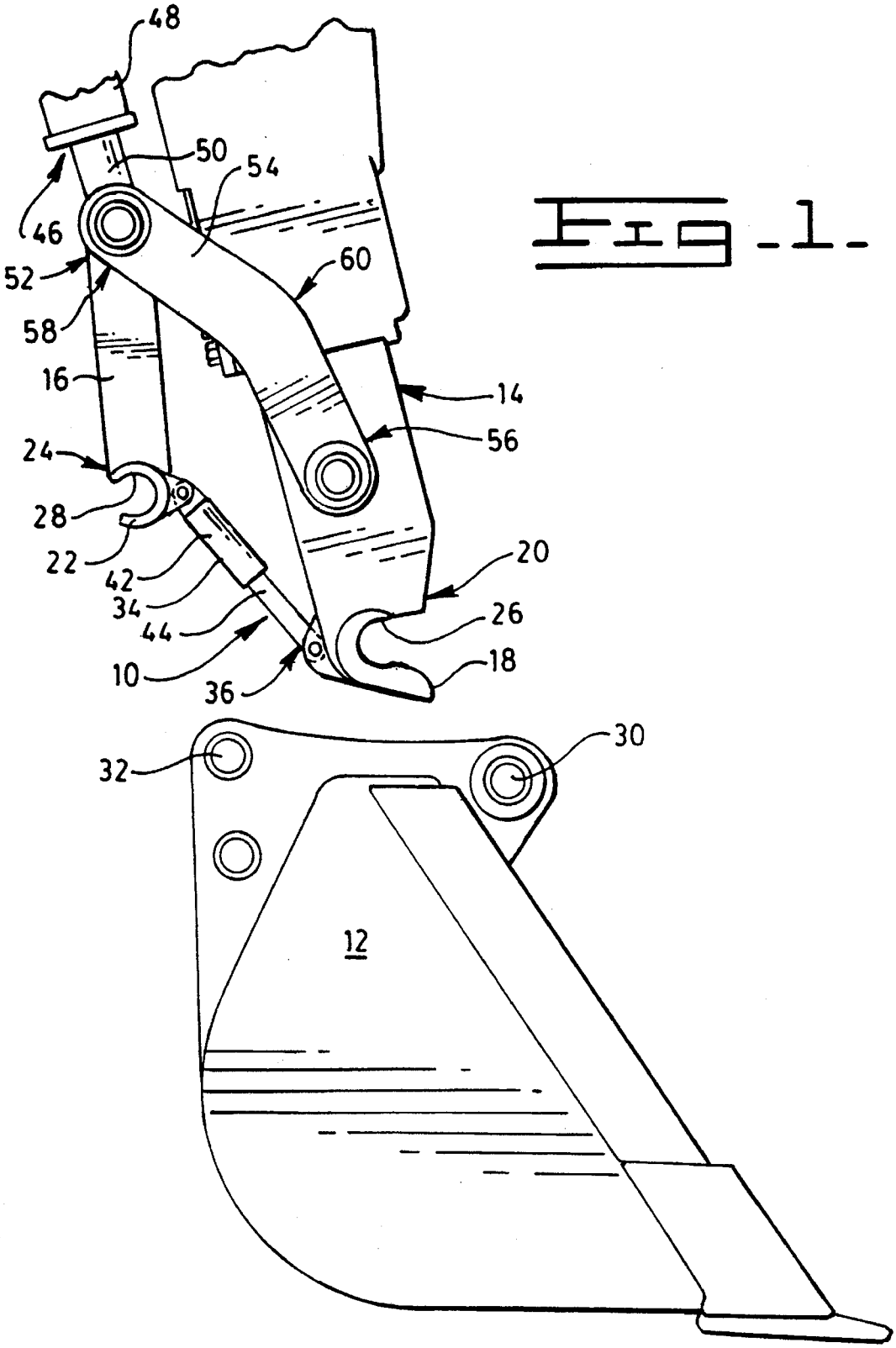
FIG. 1 is a diagrammatic side elevational view of a bucket and portions of a work machine and the present invention prior to connecting the bucket to the machine.

With reference to the drawings, a quick coupling device 10 for attaching and detaching a work implement 12, such as a bucket 12, to and from a structural arm assembly 14 and a tilt link 16 of a work machine (not shown) includes a first hook arrangement 18 at a first end portion 20 of the structural arm assembly 14 and a second hook arrangement 22 at a first end portion 24 of the tilt link 16. The first hook arrangement 18 defines a first outwardly opening recess 26, and the second hook arrangement defines a second outwardly opening recess 28. The second recess 28 opens outwardly in a direction which is substantially opposite to the outwardly opening direction of the first recess 26. The bucket 12 has a first supporting pin 30 attached thereto and a second supporting pin 32 spaced from the first pin 30 and attached also to the bucket.

The quick coupling device 10 further includes an adjustable link 34 which has a first end portion 36 pivotably connected to the first end portion 20 of the structural arm assembly 14, and a second end portion 38 pivotally connected to the first end portion 24 of the tilt link 16. The adjustable link 34 is adapted to connect the structural arm assembly 14 and the tilt link 16 to the bucket 12. This is accomplished by engaging the first recess 26 with the first supporting pin 30 and engaging the second recess 28 with the second supporting pin 32. With the recesses 26,28 engaged with the supporting pins 30,32, the bucket 12 is effectively and securely connected to the structural arm assembly 14 and the tilt link 16, and therefore to the work machine. The link 34 securely holds the supporting pins 30,32 in the recesses 26,28 until the machine operator desires to exchange the bucket 12 for a different bucket or a different type of work tool.

The adjustable link 34 is preferably an operator controlled first fluid powered cylinder assembly 40 and includes a cylinder portion 42 and an extendable and retractable rod portion 44. The adjustable link 34 can take many forms, including a threaded screw assembly, similar to a turnbuckle, or a manually actuated cylinder and rod assembly.

The tilt link 16 is movable, relative to the structural arm assembly 14, by a second fluid powered cylinder assembly 46, which includes a cylinder portion 48 and an extendable and retractable rod portion 50. The rod portion 50 is connected to a second end portion 52 of the tilt link 16. A guide link 54 has first and second end portions 56,58, with the first end portion 56 pivotably connected to the structural arm assembly 14, and the second end portion 58 pivotably connected to the tilt link 16. The second end portion 58 of the guide link 54 is also pivotably connected to the rod portion 50 of the second fluid powered cylinder assembly 46. The guide link 54 includes a curved portion 60 which is positioned substantially midway between the first and second end portions 56,58. Rotation of the bucket 12 is therefore controlled by the second fluid powered cylinder 46, the tilt link 16, and the guide link 54.

INDUSTRIAL APPLICABILITY

With reference to the drawings, and the previous detailed description, the subject quick coupling device is particularly useful with excavating and backhoe loading machines. Such machines are utilized to excavate trenches, remove and load material into trucks, lay pipelines, and perform many other types of work functions. The backhoe loaders are especially versatile by utilizing a variety of bucket sizes and types and other types of work tools. The subject quick coupling device provides quick and easy attachment and release of work implements to the work machine.

Figure 2:
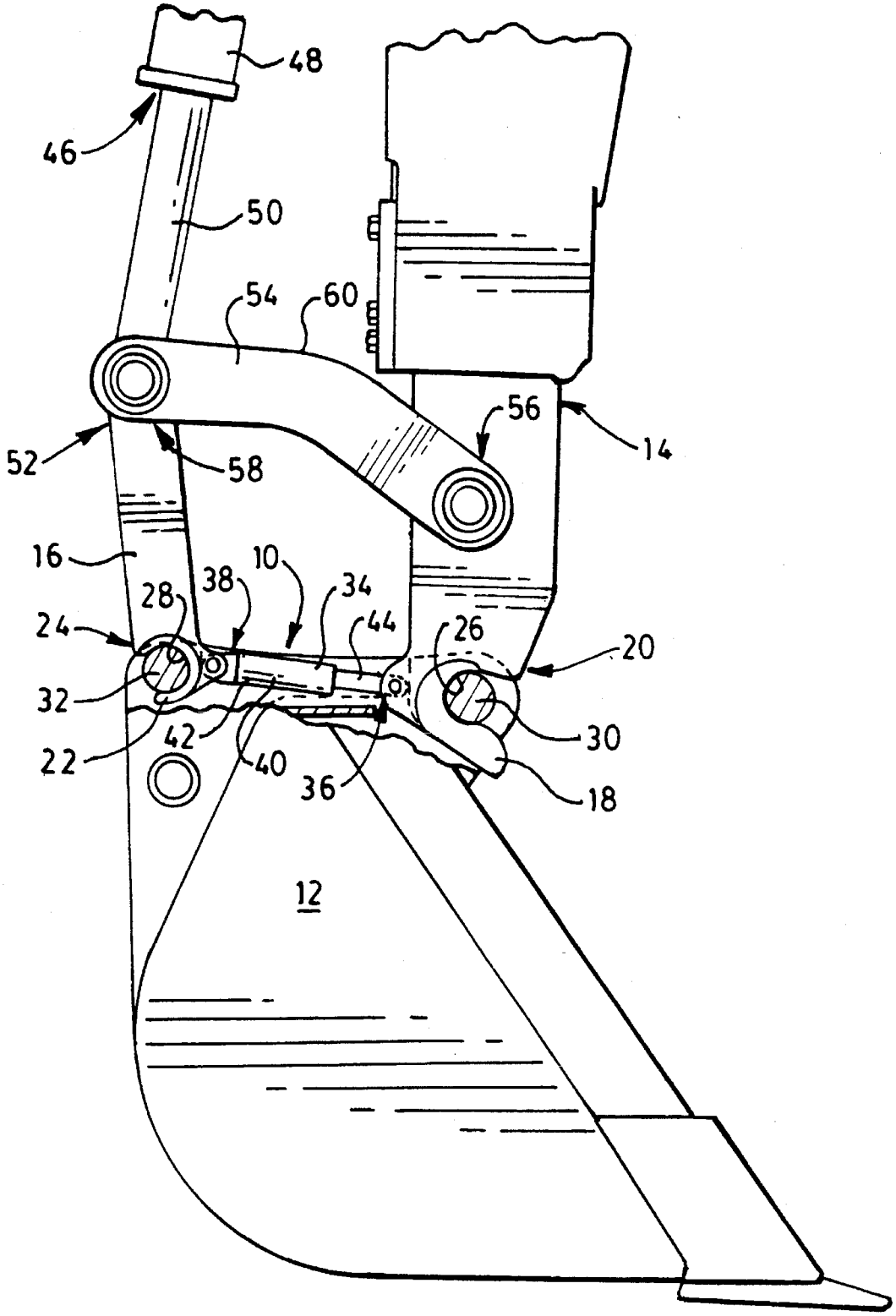
FIG. 2 is a diagrammatic side elevational view, similar to FIG. 1, with the bucket connected to the work machine and utilizing the subject invention.

With the structural arm assembly 14 and the tilt link in the position shown in FIG. 1, the work machine lowers these components until the first recess 26 of the first hook arrangement 18 engages the first supporting pin 30. The second fluid cylinder assembly 46 is then extended to align the second recess 28 with the second supporting pin 32. Activation and extension of the adjustable link 34 will engage the second recess 28 with the second supporting pin 32, as shown in FIG. 2. A force maintained within the adjustable link 34 will keep the hook arrangements 18,22 engaged with the bucket supporting pins 30,32 and the bucket can be manipulated by the structural arm assembly 14, the tilt link 16, the second fluid powered cylinder assembly 46 and the guide link 54. The bucket can be released by reversing the above described procedures.

Other aspects, objects, and advantages of this invention can be obtained from a study of the drawings, the disclosure, and the appended claims.

I claim:

1. A quick coupling device for attaching and detaching a work implement to and from a structural arm assembly and tilt link of a work machine, comprising:

a first hook arrangement formed integrally at a first end portion of the structural arm with said first hook arrangement defining a first outwardly opening recess;

a second hook arrangement formed integrally at a first end portion of the tilt link with said second hook arrangement defining a second outwardly opening recess, said second recess opening in a direction substantially opposite to the direction of said first recess;

a first supporting pin attached to said work implement;

a second supporting pin attached to said work implement;

a single adjustable link having a first end portion pivotably connected to the first end portion of the structural arm and a second end portion pivotably connected to the tilt link, said adjustable link being adapted to connect said arm and said tilt link to said work implement with said first recess engaged with said first supporting pin and said second recess engaged with said second supporting pin.

2. A quick coupling device, as set forth in claim 1, wherein said adjustable link includes a first fluid powered cylinder assembly.

3. A quick coupling device, as set forth in claim 1, wherein said adjustable link includes a threaded screw assembly.

4. A quick coupling device, as set forth in claim 1, including a second fluid powered cylinder assembly connected to a second end portion of said tilt link.

5. A quick coupling device, as set forth in claim 1, including a guide link having a first end portion pivotably connected to said structural arm assembly and a second end portion pivotably connected to said tilt link.

6. A quick coupling device, as set forth in claim 4, including a guide link having first and second end portion with said second end portion being pivotably connected to said second fluid powered cylinder assembly.

7. A quick coupling device, as set forth in claim 5, wherein said guide link includes a curved portion positioned substantially midway between said first and second end portions.

8. A quick coupling device, as set forth in claim 4, wherein said second fluid powered cylinder assembly includes a piston rod and said second end portion of said tilt link is connected to said piston rod.

* * * * *